United States Patent [19]

Bjelvert et al.

[11] Patent Number: 4,506,603

[45] Date of Patent: Mar. 26, 1985

[54] ARRANGEMENT FOR A LAND MINE

[75] Inventors: Sven Bjelvert; Göran Olofsson; Per Nyström, all of Eskilstuna, Sweden

[73] Assignee: Forenade Fabriksverken, Eskilstuna, Sweden

[21] Appl. No.: 467,838

[22] Filed: Feb. 18, 1983

[30] Foreign Application Priority Data

Feb. 22, 1982 [SE] Sweden ..... 8201069

[51] Int. Cl.[3] ..... F42B 23/00

[52] U.S. Cl. ..... 102/401; 102/427

[58] Field of Search ..... 102/427, 401; 89/1 A

[56] References Cited

U.S. PATENT DOCUMENTS 2,863,391 12/1958 Diels ..... 102/428
3,531,605 9/1970 Schrichte ..... 102/427
3,921,530 11/1975 Burkhardt et al. ..... 102/427
3,991,678 11/1976 Bjelvert ..... 102/427

FOREIGN PATENT DOCUMENTS 2266140 3/1975 France .
1494288 12/1977 United Kingdom .

*Primary Examiner*—Charles T. Jordan
*Attorney, Agent, or Firm*—Fleit, Jacobson, Cohn & Price

[57] ABSTRACT

Arrangement for a land mine which is provided with at least one magnetic field sensing device which is arranged to initiate detonation of the mine when a change in the magnetic field is sensed. A magnetic body is laid out loosely underneath the mine so that when the mine is raised from the ground this results in the mine being removed from the magnetic body, so that a change in the magnetic field which initiates detonation of the mine is sensed by the magnetic field sensing device.

3 Claims, 2 Drawing Figures

ARRANGEMENT FOR A LAND MINE

The present invention relates to a land mine which is intended to be placed in the ground, the mine being provided with at least one magnetic field sensing device which is arranged so that when a change in the magnetic field is sensed it initiates the detonation of the mine.

It is already known that in land mines, e.g. anti-tank mines, it is possible to introduce some type of mechanism which prevents it being lifted. When the mine is moved or lifted, the arrangement comes into operation and the mine is detonated. This arrangement can be in the form of a mercury tilt switch which closes a contact when the position of the mine changes. Other designs are based on fly-wheels with an excentrically-located centre of gravity or a magnetised ball which, as this runs round, induces a voltage in a sensor coil.

When mines are laid, it is occasionally a requirement that only certain selected mines be provided with booby trap arrangements. The requirement is expressed in such a way that the mine should be provided with selectable booby trap arrangement.

Hence if the mine is to be provided with a knob, button etc. which connects up the booby trap, a bushing must be provided. This results in a problem of leakage together with the risk that during the laying of the mines the button will be actuated with risk of accidents if re-safing the mine.

The purpose of the present invention is hence to provide an arrangement of the type mentioned in the introduction which is both simpler, more reliable and cheaper than booby traps previously known. This objective is achieved by means of a magnetic body, which is placed loosely underneath the mine, so that when the mine is lifted out of the soil this results in the mine being removed from the magnetic body so that a change in the magnetic field which initiates the detonation of the mine is sensed by the device which senses the magnetic field.

The invention will be described in greater detail in the following by reference to the appended drawing which illustrates a preferred embodiment of the invention.

Figure 1:
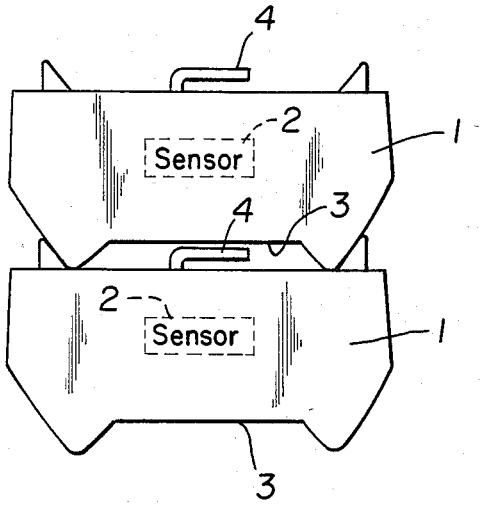
FIG. 1 illustrates a type of mine which is particularly suitable for being provided with an arrangement in accordance with the invention.

FIG. 1 illustrates a land mine in the form of a conventional "antitank mine" 1, containing a sensor 2 which is indicated only schematically, for sensing changes in the magnetic field. The sensor consists in a known manner of two coils (not shown) connected in opposition and placed one above the other. Small magnetic objects close to the upper or the lower coil give rise to electrical signals which can be employed to detonate the mine.

As such coils are obviously well known to a person versed in the state of the art, they have not been shown on the drawing.

The mine 1 is provided with a recess 3 in the base so as to permit stacking. Consequently this recess covers the actuation knob 4 of the underlining mine.

Figure 2:
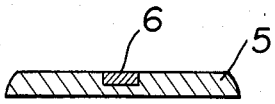
FIG. 2 illustrates an embodiment of the invention adapted to suit the type of mine illustrated in FIG. 1.

In accordance with the invention the mine is provided with a loose unit in the form of a disc 5, made for example of plastic (see FIG. 2) which fits into the recess 3. There is a small permanent magnet 6 attached to the disc 5.

If it is desired that the mine 1 is to be protected against being re-lifted, the disc 5 is placed underneath the mine when it is laid. The magnet 6 does not detonate the mine, because this is activated only after a certain time delay (the arming time). When the arming time has expired the mine is active and is protected by the magnetic disc 5. If anyone should now lift the mine the disc 5 will remain behind, so that the sensor 2 of the mine is removed from the magnet 6. This results in such strong signals being produced that the ignition system initiates the mine.

If mines, once laid, are subjected to strong vibration and shaking, which can occur for example during an artillary shelling because of its shape the disc 5 will follow the movements of the mine 1 laterally. Consequently no signals are produced and no detonation takes place. In other known booby trap arrangements it is necessary to have some sensing device which locks the booby trap in the event of severe shocks.

The arrangement solves the problem described above in a simple and cheap manner. It provides freedom of choise in selecting or dispensing with booby traps. By not issuing any discs to the mine laying personnel, this ensures that booby-trapped mines are not laid in error if the re-lifting alternative is selected.

We claim:

1. Arrangement for a land mine (1) designed to be placed in the ground, the mine being provided with at least one magnetic field sensing device (2) which is arranged to initiate detonation of the mine when a change in the magnetic field is sensed, characterised by a magnetic body loosely laid underneath the mine (1), as a result of which the removal of the mine from the ground results in the mine being removed from the magnetic body, so that a change in the magnetic field which initiates detonation of the mine is sensed by the magnetic field sensing device (2).

2. Arrangement as in claim 1, characterised in that the magnetic body comprises a disc (5) of plastic or the like in which a permanent magnet (6) is fastened.

3. Arrangement in accordance with claim 1, characterised in that the magnetic body is designed as a disc (5) which is introduced into a corresponding recess (3) in the mine (1).

* * * * *